US005950383A

United States Patent [19]

Williamson et al.

[11] Patent Number: 5,950,383

[45] Date of Patent: Sep. 14, 1999

[54] METAL ROOF SEALING SYSTEM AND METHOD

[75] Inventors: Robert B. Williamson, Berkeley, Calif.; Edward G. Kane; John B. Letts, both of Carmel, Ind.

[73] Assignee: Bridgestone Corporation, Tokyo, Japan

[21] Appl. No.: 09/097,628

[22] Filed: Jun. 16, 1998

Related U.S. Application Data

[60] Provisional application No. 60/052,004, Jul. 9, 1997.

[51] Int. Cl.[6] ..... E04B 7/00; E04D 11/02; E04G 21/14

[52] U.S. Cl. ..... 52/408; 52/537; 52/588.1; 52/741.4; 52/746.11; 52/748.1

[58] Field of Search ..... 52/588.1, 536, 52/537, 538, 540, 741.4, 746.11, 748.1, 748.11, 411, 408

[56] References Cited

U.S. PATENT DOCUMENTS

| | | | |
|---|---|---|---|
| 2,106,390 | 1/1938 | Crane . | |
| 2,616,283 | 11/1952 | Branstrator et al. . | |
| 3,511,007 | 5/1970 | Babcock . | |
| 3,763,614 | 10/1973 | Hyde et al. . | |
| 4,237,182 | 12/1980 | Fulmer et al. . | |
| 4,449,336 | 5/1984 | Kelly . | |
| 4,747,247 | 5/1988 | Petersen, Jr. et al. . | |
| 4,759,165 | 7/1988 | Getoor et al. | 52/746.11 |
| 4,936,071 | 6/1990 | Karrfalt . | |
| 5,392,583 | 2/1995 | Gregory . | |
| 5,479,753 | 1/1996 | Williams . | |
| 5,540,022 | 7/1996 | Morris | 52/746.11 |

*Primary Examiner*—Michael Safavi
*Attorney, Agent, or Firm*—Daniel N. Hall

[57] ABSTRACT

A sealing system and method for a metal roof having a plurality of sheet metal panels attached to a roof deck covered by a layer of insulation, such as polystyrene. The joints and seams formed at junctions of adjacent plates are sealed with a nonflammable or low combustible, char forming, non absorbent layer of material which is applied over the seams in a liquid or slurry form, which subsequently hardens to form a liquid proof seal to reduce the flow of molten polystyrene from melting of the adjacent layer of insulation, into the fire below.

18 Claims, 4 Drawing Sheets

METAL ROOF SEALING SYSTEM AND METHOD

CROSS REFERENCE TO RELATED APPLICATION

This application claims the benefit of U.S. Provisional application Ser. No. 60/052,004, filed Jul. 9, 1997.

BACKGROUND OF THE INVENTION

1. Technical Field

The invention relates to roofing structures for buildings and more particularly to metal deck roof structures having an overlay of a meltable insulation material. Even more particularly the invention relates to such a roofing structure which seals openings formed at the junctions of the overlapping metal sheets and provides both a thermal and physical barrier preventing the insulation material upon becoming liquid during a fire, from leaking into the building below.

2. Background Information

Roofing systems for commercial and industrial buildings utilize various types of sheet metal panels which are laid in an overlapping relationship and secured to a lower structured frame of a roof deck. An insulation layer is laid on top of the metal sheets which is then covered by a waterproof material, one common type of which is EPDM, together with a ballast or other hold down system. One type of insulation material is a polystyrene foam which is expanded or extruded, usually in sheets, which provide the desired insulating qualities as well as being lightweight thereby contributing very little to the overall weight load of the roof.

However, one problem with the use of such foam insulation in roofing structures is that the foam can melt and burn when the building experiences a fire, and more importantly becomes liquid with the resulting molten liquid flowing through the joints of the roof deck into the building interior below increasing the hazard to occupants as well as to the safety forces during a fire. These metal roof deck sheets are usually fluted with peaks and valleys, with the overlying joint formed between adjacent panels, which usually occurs in a valley, which makes the joint opening very susceptible to the molten liquid flowing through the joint opening and other openings in the steel deck and into the building below. Various systems have been devised to provide an effective seal to metal roof decks, either to prevent the flow of water or other liquid through the joints and panel openings and into the building interior.

U.S. Pat. Nos. 2,106,390 and 2,616,283 disclose roof structures in which the flutes of the metal decks are filled with a granular material. However, this filling material hardens and is used to provide the attachment means for receiving nails or other fasteners for securing the insulation on the top of the metal sheets and not for sealing the overlap joint of adjacent roof deck sheeting.

U.S. Pat. No. 4,936,071 discloses a metal roof wherein the joints are sealed with a tape laminate formed of an unvulcanized EPDM and butyl rubber to provide for a waterproof seal at the overlapping joints.

U.S. Pat. No. 5,392,583 discloses another metal roof installation using flexible elongated elastic strips for sealing the overlapping joints.

U.S. Pat. No. 5,479,753 discloses a metal roof in which an elongated strip of flexible hot melt thermoplastic bituminous composite material is placed over the overlapping joints or seams and heated to bond the strip to the metal roof to provide a weather proof seal therebetween.

U.S. Pat. Nos. 3,763,614 and 4,449,336 disclose other metal roofing structures using various types of barriers between the insulation and the roof deck for reducing the harmful affect should the building experience a fire.

U.S. Pat. No. 4,747,247 discloses a roof system in which the troughs or valleys of the metal sheets are filled with various nonflammable loose packed granular inorganic material which is intended to absorb the molten liquid resulting from the insulation sheets during a fire. However, a major draw back of this type of system is that it adds considerable weight to the building since nearly every trough or valley must be filled with this loose packed granular material. Even if a light weight granular material is used, the weight required to be supported by the underlying roof deck is increased considerably due to the vast amount of material that is required to fill the valleys and troughs in order to absorb the heated liquid material.

U.S. Pat. No. 3,511,007 discloses still another metal roofing structure in which a closed cell non-absorbent foam material is sprayed on the edge of the metal roof sheet, individually or in combination with a breaker strip, for bonding to the undersurface of the adjacent metal sheet edge when it is placed thereon to provide a waterproof seal at the joint formed by the overlapping metal panel edges.

Although these various roof systems achieve certain desired results, in many instances they either materially increase the weight that must be supported by the roof, or are expensive and time consuming to install due to the amount of material required and the labor cost to install the same.

Therefore the need exists for an improved method and roof sealing system which does not materially increase the weight of the roof and which is inexpensive and easy to install, yet provides for the desired fire resistant liquid seal between overlapping joints of adjacent metal panels to prevent the molten liquid formed by the overlying insulation during a fire from flowing into the building below.

SUMMARY OF THE INVENTION

Objectives of the invention include providing a metal roof sealing system and method having a plurality of overlapping fluted metal sheets covered with a meltable insulation layer for supporting an overlying waterproof membrane and hold down means, wherein the openings formed at the overlapping joints of the metal sheets are sealed with a sealing compound such as polyurethane foam and/or a type of cementitious material which forms both a thermal and physical barrier to the passage of molten material.

A further objective of the invention is to provide such a roofing system in which the overlapping metal sheets or metal plates are sealed both along the overlapping side edge joint and also along the end edge joints by the sealing material.

A still further objective of the invention is to provide such a roof sealing system in which the cementitious material may be a common mortar, gypsum plaster, Portland cement and sand, etc. which when applied is in a paste or slurry form and then hardens to form the sealing bead or strip which extends along the overlapping joint, usually in the bottom of a trough or valley of the fluted metal sheets.

Another objective of the invention is to provide such roof sealing system in which a polyurethane sealing foam is applied in a liquid or slurry state and quickly turns into a solid to form an effective thermal liquid proof barrier for the steel deck joints.

Still another objective of the invention to provide such a roof sealing system in which the sealing material needs to be applied only at the joints or other openings in the metal deck, such as around vent ducts or the like, eliminating its use in the other troughs or valleys of the fluted metal sheets, thereby reducing the weight required to be supported by the underlying roof structure and reducing the amount of materials and associated costs of applying the same.

A further objective of the invention is to provide such a roof sealing system in which the sealing of the joints materially reduces the amount of melted insulation material which drops into the space below thereby removing material which heretofore is ignited by the existing fire.

These objectives and advantages are obtained by the improved metal roofing system of the invention the general nature of which may be stated as including a plurality of sheet metal panels attached to a structure of a building and forming seams at the junctions with adjacent panels; and in which a nonflammable or low combustible, char-forming, nonabsorbent layer of an applied-in-place sealing material is applied in a liquid or slurry form along the seams and upon hardening forms a thermal liquid proof barrier for the seam.

These objectives and advantages are further obtained by the improved method of fabricating a roof system, the general nature of which may be stated as including the steps of providing a supporting roof deck; securing a plurality of overlapping sheet metal panels to the roof deck thereby forming seams at junctions with adjacent overlapped panels, said panels having alternating grooves and ridges; placing a nonflammable or low combustible, char-forming, nonabsorbent layer of sealing material in a slurry form along certain of the seams; permitting said slurry to harden to form a thermal and liquid barrier over said certain seams; placing a plurality of thermoplastic insulation panels on the ridges of said metal panels; placing a waterproof membrane over the insulation panels; and securing said membrane to said roof deck.

BRIEF DESCRIPTION OF THE DRAWINGS

A preferred embodiment of the invention illustrative of the best mode in which applicants have contemplated applying the principles is set forth in the following description and is shown in the drawings and is particularly and distinctly pointed out and set forth in the appendant claims.

Similar numerals refer to similar parts throughout the drawings.

DESCRIPTION OF THE PREFERRED EMBODIMENT

Figure 1:
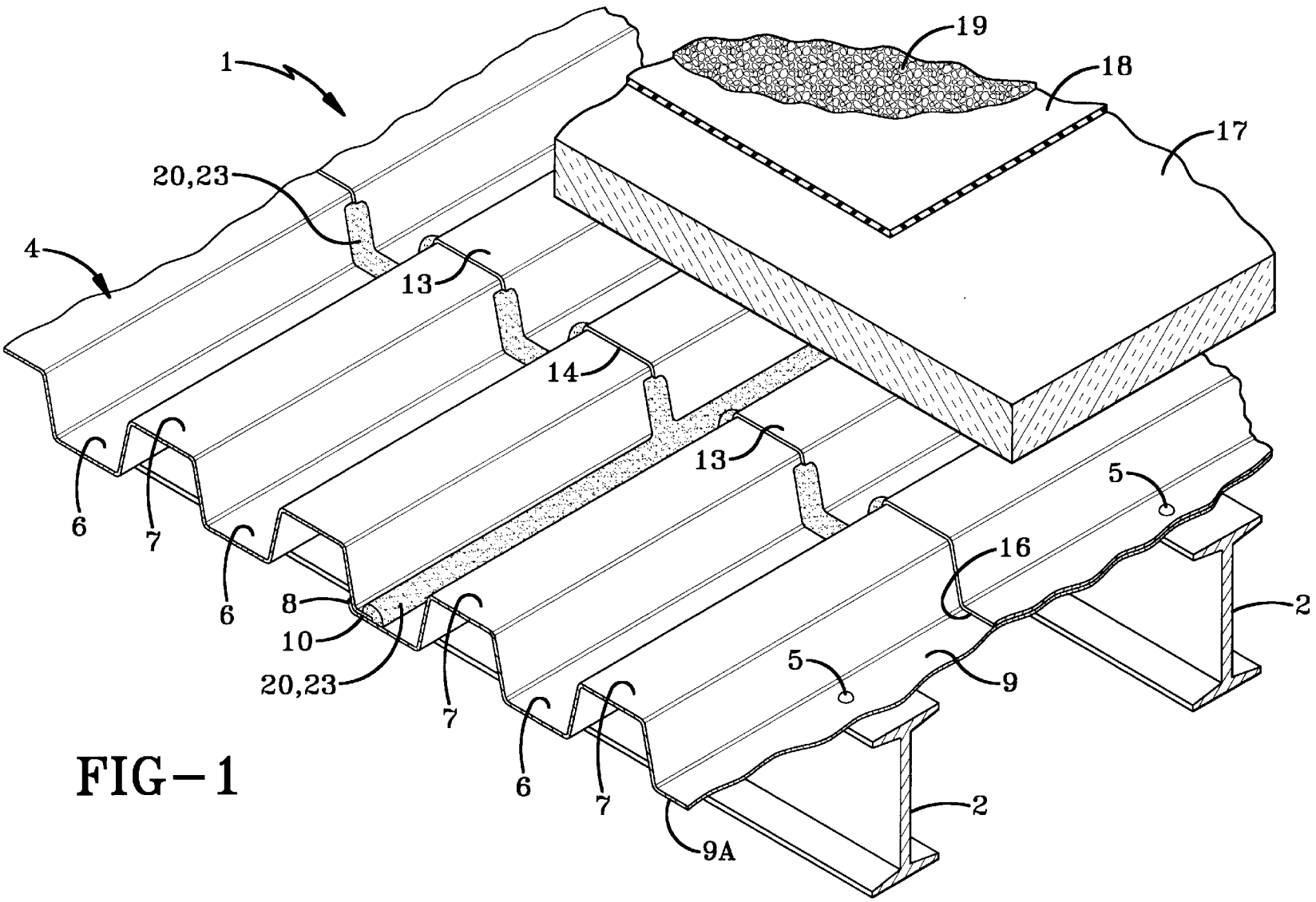
FIG. 1 is a diagrammatic perspective view with portions broken away and in section, of a metal roof incorporating the improved sealing system therein.

The improved metal roof system of the present invention is indicated generally at 1, and is shown in a generally diagrammatic fragmentary sectional breakaway view in FIG. 1. Roof system 1 includes a structural frame of the roof deck, which as shown in the drawing consists of a plurality of spaced I-beams 2, which could be other types of roof deck supports, such as bar joists, wooden or metal pylons or the like.

Figure 2:
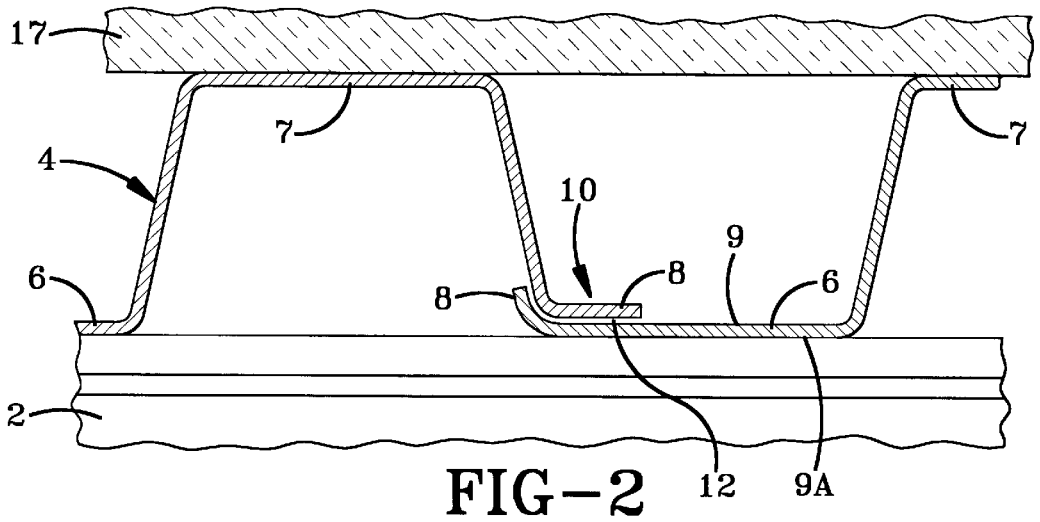
FIG. 2 is an enlarged fragmentary sectional view showing the seam opening formed at the junction of a pair of adjacent roof panels prior to placement of the sealing strip thereon.

A plurality of generally similar sheet metal panels, each of which is indicated generally at 4, are mounted on and secured to beams 2 by plurality of fasteners 5 such as nails, screws, by welding or other attachment means. Each panel 4 is formed by a plurality of alternating flutes or grooves 6 and intervening ridges 7 and have top and bottom surfaces 9 and 9A respectively. Adjacent panels 4 have their terminal longitudinally extending ends 8 overlapped by the inmost ridge of adjacent panels as shown particularly in FIG. 2. The adjacent panels are secured to each other usually in the flutes or valleys 6 by spot welds or by a plurality of sheet metal screws or other fasteners. This overlapping relationship forms a longitudinally extending seam 10, which due to manufacturing tolerances and irregularities in the roof deck, will usually result in an opening 12 formed at seam 10. Also the transverse ends 13 of adjacent panels are overlapped, as shown in FIG. 1 forming a seam 14 which extends transversely to the longitudinal direction of the flutes and ridges of each panel. This seam will also result in an elongated transverse opening 16 through which water and molten liquid insulation can flow through and into the building below.

Roof system 1 further includes a plurality of sheets or panels of insulation 17 such as polystyrene, which are loose-laid or secured to ridges 7 of panels 4 by usual attachment means and extend generally throughout the entire area of the roof. Next, a layer of a waterproof membrane 18, such as EPDM, extends across and can be secured to insulation panels 17 by well known fastening means, or a layer of a ballast 19, such as gravel, is then applied to keep membrane 18 in position. Other types of membrane retaining means other than ballast 19 can be used without affecting the concept of the invention.

Figure 3:
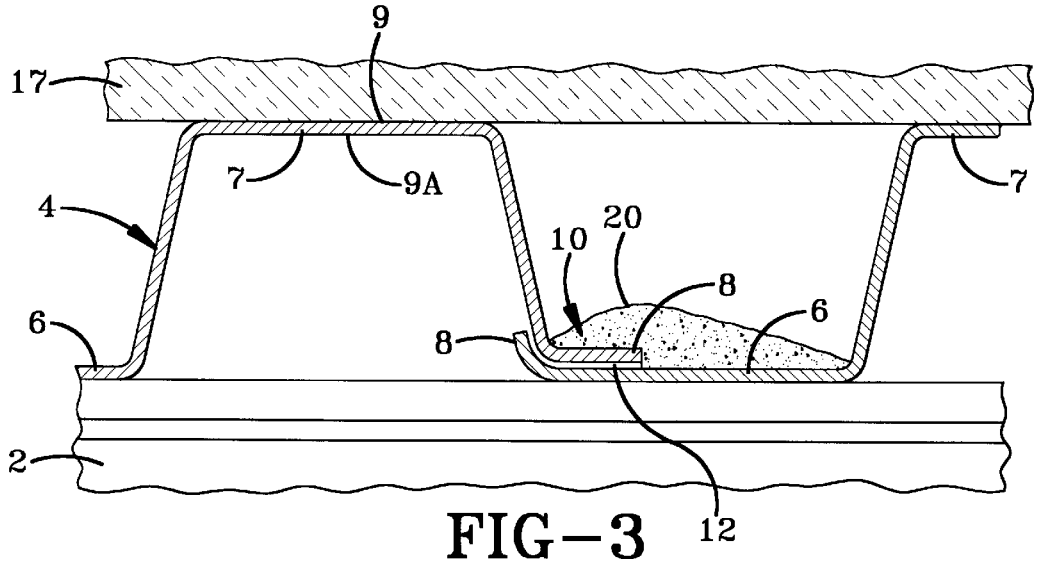
FIG. 3 is an enlarged fragmentary sectional view similar to FIG. 2, showing the sealing seam being formed of a cementitious material.
Figure 4:
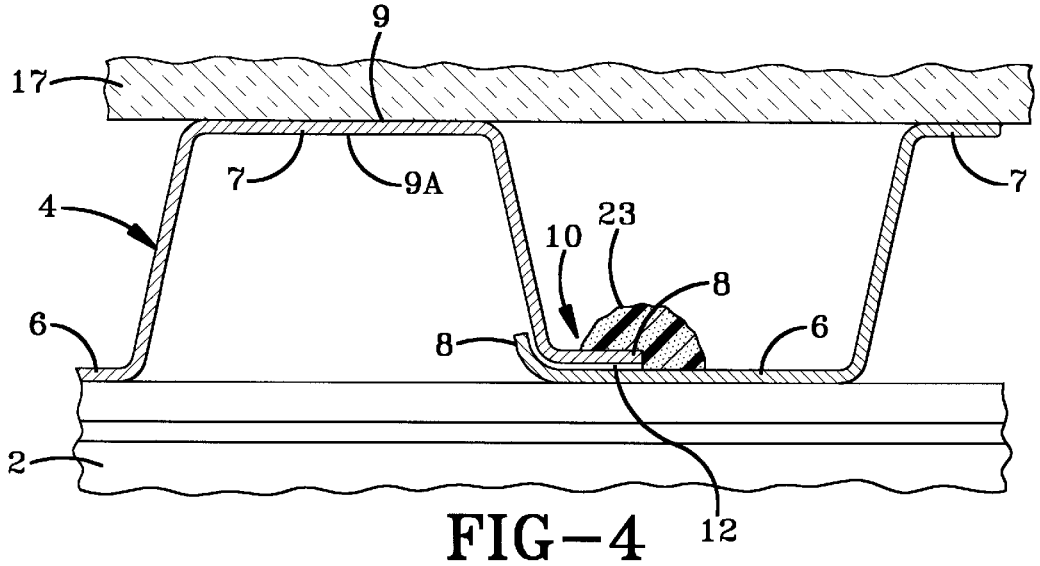
FIG. 4 is an enlarged fragmentary sectional view similar to FIGS. 2 and 3, showing the seam formed of a polyurethane foam.

In accordance with the invention, a bead or strip of a flame retardant waterproof barrier 20 is applied along both the longitudinal and transverse seams 10 and 14, respectively, as shown generally in FIG. 1 and in detail in FIGS. 3 and 4, to seal openings 12 and 16, and at other openings such as around vents, ducts, skylights, etc.

In a first embodiment as shown in FIG. 3, sealant strip 20 is a cementitious material such as gypsum plaster with or without a vermiculite, a common mortar, such as Portland cement and sand. The advantage of this type of material is that upon setting there is very little (a slight contraction) dimensional change, which is important in this application. Different types of plasters are made which vary in the time taken to set, the amount of water to make a pourable material and the hardness. These characteristics are controlled by the calcination conditions and by addition of other materials (organic and inorganic) to the plaster. Mortar is mixture of solids and water used to generally bond masonry units together. The principal solids in mortar are sand and cementitious materials, such as hydrated lime, (or slaked quicklime) and Portland cement. The definition of portland cement is given in ASTM C 150 as a hydraulic cement produced by pulverizing clinkers consisting essentially of hydraulic calcium silicates, usually containing one or more of the forms of calcium sulfate as an interground addition. The definition of hydraulic cements is that they harden by reacting with water to form a water-resistant product. Gypsum will dissolve in water after it is hardened and is therefore not as useful a portland cement in many application. There are many other cementitious materials, but none is more important than portland cement. The latter is absent in pure lime mortar. Portland cement reacts rapidly with water, which gives the mortar its initial set. Lime react more slowly, both with carbon dioxide from the atmosphere to form calcium carbonate and with sand to form calcium silicates. Thus, mortar hardens with age and has good workability. Again, variations in composition can effect how flowable the mortar is and how fast it hardens. Organic and inorganic materials including organic plastics can be added to the mortar to improve performance.

FIG. 4 shows a modified form of sealant strip 23 which is a polyurethane foam having a flame retardant of approximately 100 parts per hundred parts polyol, and with an index up to 250. Other examples of flame retardants can be antimony oxide, calcium carbonate, and pentabromodiphenyl oxide. The use of sucrose and/or aromatic polyols (Hoechst Celanese's Terate 2541 (aromatic polyester polyol) and Dow's Voranol 490 (sucrose based)) which forms a protective char layer during a fire is highly resistant to further combustion. The corresponding polyurethane foam has a density of approximately 1 to 6 pounds per cubic feet.

Sealant strips 20 and 23 provide a physical barrier to the flow of molten thermoplastic material which results when insulation panels 17 are subjected to very high temperatures, such as in a fire. This molten thermoplastic material is prevented by strips 20 and 23 from flowing through openings 12 and 16 and into the building below through the space normally present between the overlapped roof deck panels. Various sealant strips 20 and 23 will be fire resistant and/or char forming and are able adhere to the sheet metal panels 4, and turn into a solid from a liquid or slurry state relatively quickly when applied thereto.

The method of the present invention is best understood by reference to FIG. 1 which shows the attachment of panels 4 to the supporting roof deck which is then followed by the application of the cementitious material or polyurethane foam sealing strips 20 and 23. Since only the seams are covered by the sealing strips, it results in very little additional weight to the roof and requires only a relatively small amount of material in order to provide the thermal and/or physical barrier in contrast to those systems in which the grooves or troughs are completely filled with a particulate material. Next, insulation panels 17 are loose-laid or secured to ridges 7 of panels 4 afterwhich waterproof membrane 18 is laid thereon and secured by fasteners or by ballast 19.

Two full scale compartment fire tests were conducted on prototype roof systems to quantify the effects of the subject roof sealing system. One test had no roof sealing material which is referred to as the "control", and the other test had the openings in the roof deck sealed with gypsum plaster which is one of the cementitious materials discussed above. Each fire test involved placing an "ignition source" below the roof deck and producing a steady flame on the underside of the roof deck. Both roof deck assemblies contained 10 inch thick Expanded Polystyrene (ESP) foam directly applied to the steel deck. The compartment was 12 feet long and 8 feet wide, and there was a full width opening in one of the 8 foot wide walls. The ignition source consisted of a standardized propane-fire burner one foot square which was programmed to produce a steady flame source on the underside to the roof deck. This ignition source represented a serious fire, but a fire that was localized to the rear half of the 12 foot long compartment. There were flames out the front of the compartment within 2 minutes 21 seconds in the control test with out the sealing material. These flames were clearly caused by flammable vapors from the EPS being forced through the two seams in the test deck, and they continued to exit the compartment for over 5 minutes. At times these flames were extending more than 8 feet beyond the front of the compartment. In the fire test with the sealed deck seams there was some light flaming on one of the seams for approximately 3 minutes, but there were only a few flame "packets" that came out of the front of the compartment. There was also some localized flaming at the back of the compartment at intersection of the side and rear wall. This flaming at the back of the compartment was an artifact of a defect in the test set-up where the molten EPS could leak into the compartment.

A video recording was made of the test, and careful observations show that the sealing of the seams prevented the EPS from contributing significantly to the spread of the fire in the test compartment.

Figure 5:
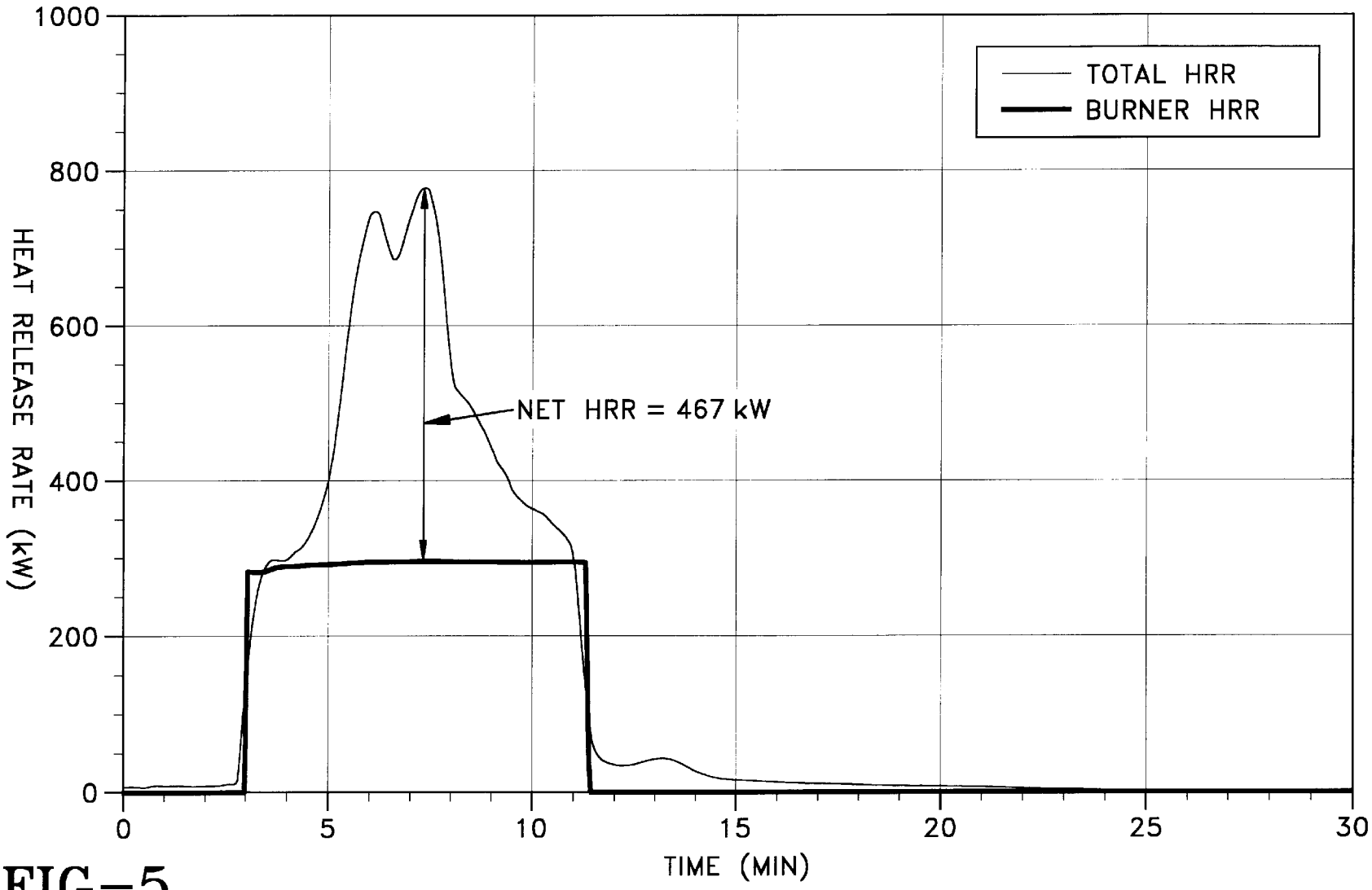
FIG. 5 is a chart showing the rate of heat release in a test fire when the metal roof joints are not sealed in accordance with the present invention.
Figure 6:
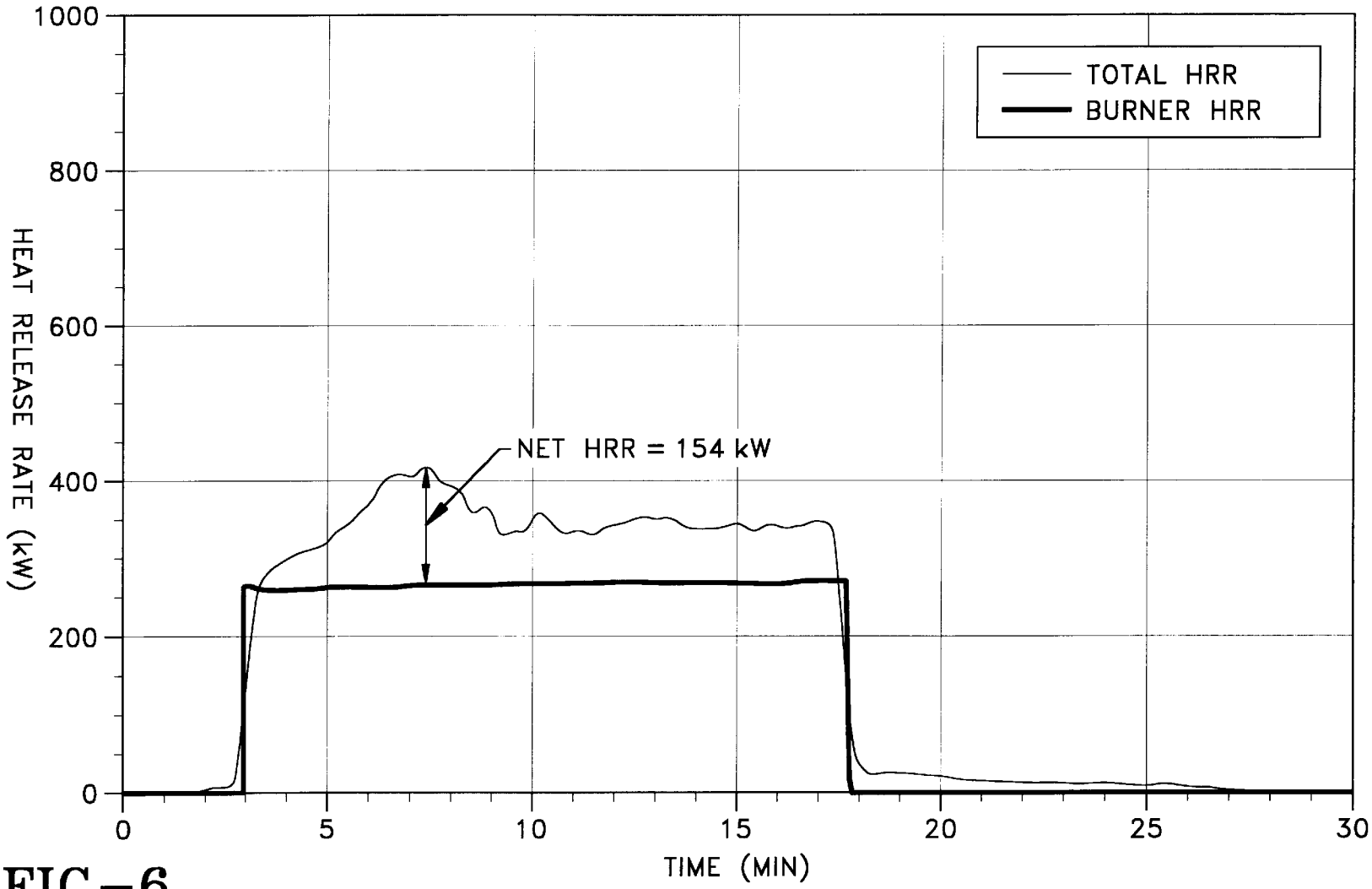
FIG. 6 is a chart showing the heat release rate in a similar test fire represented in FIG. 5 utilizing the sealing system of the present invention.

Another important measurement in fire testing is the "heat release rate" (HRR). The HRR can be calculated by measuring the oxygen "depletion" in the combustion products leaving the test compartment. The HRR for the control test is shown in FIG. 5, and that for the sealed deck is shown in FIG. 6. The HRR is a good measure of the way in which a material might spread a fire inside a building. The ignition source in these fire tests is between 260 kW and 290 kW, and the most meaningful measure of the fire contribution of a material or system is to subtract the HRR associated with the ignition source and consider the "net" HRR. The net HRR for the control test is approximately 467 kW while that for the sealed deck test is 154, and thus the "control" experiment without the fire stop material gives three times higher HRR than the sealed deck. Thus, a considerable reduction in HRR is achieved by the sealing system of the present invention which materially reduces the amount of molten melted insulation which heretofore dripped into the fire area below the roof.

Thus, the roof system of the present invention provides an extremely simple and inexpensive solution to a problem that has long existed in the art, that is the providing of a thermal and/or physical liquid barrier preventing the molten liquid resulting from the melting of the installation panels from flowing through openings in the roof and dropping into the building space below the roof deck.

Accordingly, the improved metal roof sealing system and method is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purpose and are intended to be broadly construed.

Moreover, the description and illustration of the invention is by way of example, and the scope of the invention is not limited to the exact details shown or described.

Having now described the features, discoveries and principles of the invention, the manner in which the improved metal roof sealing system and method is constructed and used, the characteristics of the construction, and the advantageous, new and useful results obtained, the new and useful structures, devices, elements, arrangements, parts and combinations, are set forth in the appended claims.

We claim:

1. A metal roofing system including:

a plurality of sheet metal panels having top and bottom surfaces and being attached to a structure of a building and forming seams at junctions with adjacent panels;

a plurality of insulation panels overlaying and supported by the top surfaces of the metal panels;

a waterproof membrane overlaying the insulation panels; and a strip of a nonflammable or low combustible, char forming, non-absorbent applied-in-place sealing material positioned only over the seams on the top surfaces of adjacent panels in a liquid or slurry which hardens to form a liquid proof seal for said seams.

2. The roofing system defined in claim 1 in which the sealing material is a flame retardant polyurethane foam.

3. The roofing system defined in claim 2 in which the polyurethane foam has a density of approximately 1 to 6 pounds per cubic feet.

4. The roofing system defined in claim 1 in which the sealing material is a cementitious material.

5. The roofing system defined in claim 4 in which cementitious material is Portland cement and sand.

6. The roofing system defined in claim 1 in which the insulation panels are formed of a thermoplastic.

7. The roofing system defined in claim 6 in which the thermoplastic is polystyrene.

8. The roofing system defined in claim 1 including a layer of ballast overlaying the waterproof membrane.

9. The roofing system defined in claim 8 in which the ballast is gravel.

10. A method of fabricating a roof system including the steps of providing a supporting roof deck; securing a plurality of overlapping sheet metal panels to the roof deck thereby forming seams at junctions with adjacent overlapped panels, said panels having a top surface and alternating grooves and ridges; placing strips of a nonflammable low combustible, char-forming, nonabsorbent sealing material in a slurry form along certain of the seams on the top surface of said panels; permitting said slurry to harden to form a thermal and liquid barrier strips over said certain seams; placing a plurality of thermoplastic insulation panels on the ridges of said metal panels; placing a waterproof membrane over the insulation panels; and securing said membrane to said insulation deck.

11. The method defined in claim 10 including the step of forming the sealing material of a flame retarded polyurethane foam.

12. The method defined in claim 11 including the step of forming the polyurethane foam with a density of approximately 1 to 6 pounds per cubic feet.

13. The method defined in claim 10 including the step of forming the sealing material of a cementous material.

14. The method defined in claim 10 including the step of forming the cementous material of portland cement and sand.

15. The method defined in claim 10 including the step of forming the insulation panels of a thermoplastic.

16. The method defined in claim 10 including the step of forming the insulation panels of polystyrene.

17. The method defined in claim 10 including the step of applying a layer of ballast on top of the waterproof membrane.

18. The method defined in claim 17 including the step of forming the ballast of gravel.

* * * * *